US006058570A

United States Patent [19]

Baechler

[11] Patent Number: 6,058,570

[45] Date of Patent: May 9, 2000

[54] INFLOW SENSOR FOR A DRAWING EQUIPMENT

[75] Inventor: François Baechler, Uster, Switzerland

[73] Assignee: Zellweger Luwa AG, Uster, Switzerland

[21] Appl. No.: 09/284,870

[22] PCT Filed: Oct. 21, 1997

[86] PCT No.: PCT/CH97/00394

§ 371 Date: Apr. 22, 1999

§ 102(e) Date: Apr. 22, 1999

[87] PCT Pub. No.: WO98/18985

PCT Pub. Date: May 7, 1998

[51] Int. Cl.[7] ..... D01H 5/32

[52] U.S. Cl. ..... 19/239; 19/236; 19/157

[58] Field of Search ..... 19/0.23, 0.24, 19/65 A, 145.5, 157, 159 R, 236, 237, 238, 239, 240, 258, 260, 288

[56] References Cited

U.S. PATENT DOCUMENTS

| | | | |
|---|---|---|---|
| 3,184,798 | 5/1965 | Burnet et al. | 19/65 |
| 4,266,324 | 5/1981 | Hasegawa et al. | 19/239 |
| 4,974,296 | 12/1990 | Vidler | 19/239 |
| 5,161,284 | 11/1992 | Leifeld | 19/260 |
| 5,230,125 | 7/1993 | Clement et al. | 19/236 |
| 5,248,925 | 9/1993 | Jornot | 19/239 |
| 5,428,870 | 7/1995 | Rutz et al. | 19/240 |
| 5,457,851 | 10/1995 | Mondini | 19/239 |
| 5,487,208 | 1/1996 | Hauner | 19/157 |

FOREIGN PATENT DOCUMENTS

| | | |
|---|---|---|
| 2 204 717 | 5/1974 | France . |
| 32 12 891 | 10/1983 | Germany . |
| 60-094626 | 5/1985 | Japan . |

*Primary Examiner*—Michael A. Neas
*Assistant Examiner*—Gary L. Welch
*Attorney, Agent, or Firm*—Burns, Doane, Swecker & Mathis

[57] ABSTRACT

The invention concerns a process and a device for recording a parameter on several slivers (11) fed to a controlled drawing frame. In order to produce a more accurate measured value and at the same time influence the slivers to the smallest possible extent, several measuring elements (9) are provided which are individually assigned to the slivers and whose measured values are converted to a single measured value for the control.

3 Claims, 3 Drawing Sheets

INFLOW SENSOR FOR A DRAWING EQUIPMENT

Figure 1:
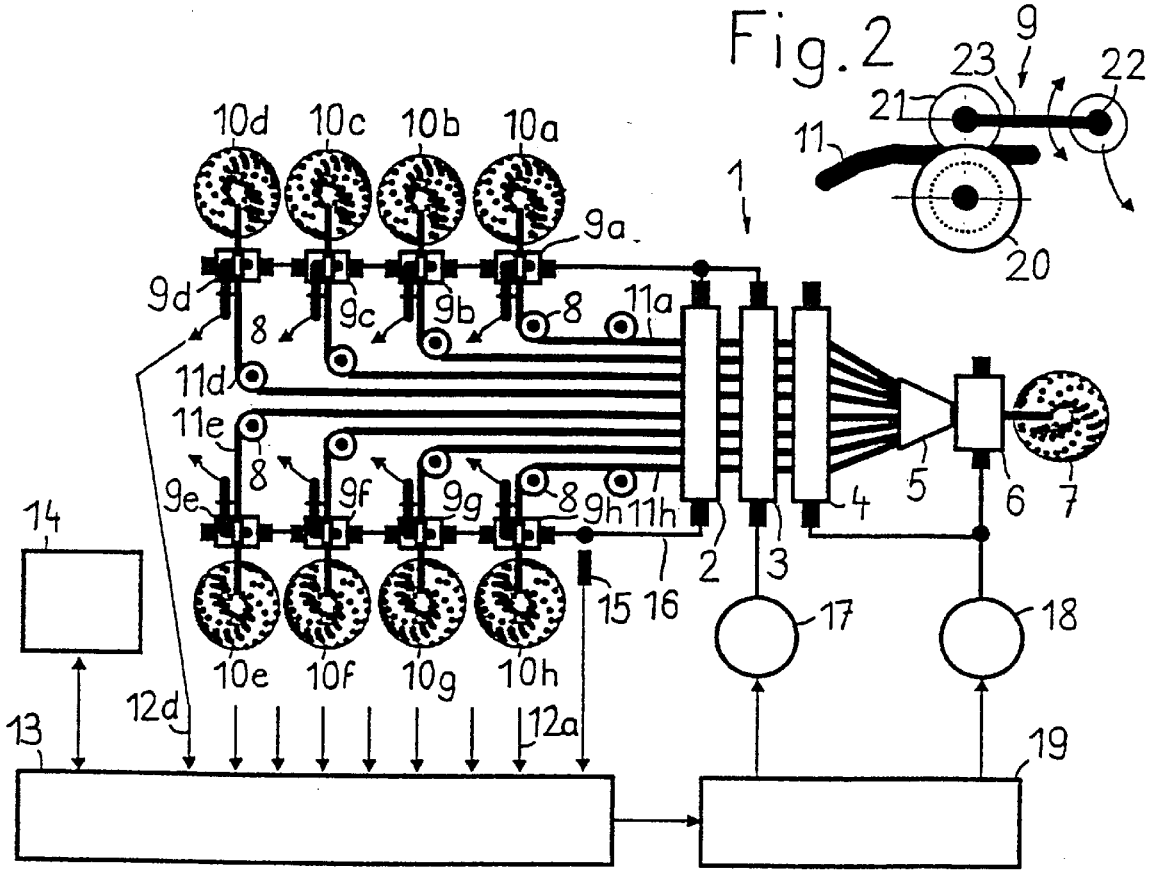

The invention concerns a process and a device for recording a parameter on several slivers fed to a drawing frame.

U.S. Pat. No. 4,974,296, for example, discloses a drawing frame by which several incoming slivers made of textile fibres, which are drawn from a number of cans, are combined and drawn into a single homogeneous sliver. This drawing frame has a measuring device at the inlet, which is intended to detect variations in cross-section and mass in a number of slivers. This measuring device extends over all incoming slivers, registers all slivers jointly and outputs a single measured value for all slivers together.

Such known devices can detect a number of slivers together by capacitive means or scan them mechanically, for example, via pressure rollers. If pressure rollers are provided, the pressure exerted on the slivers is usually quite high in order to achieve accurate measured values. In this case the properties of the slivers have already been modified and combined so that the following drafting process is impaired. Where parameters are detected by capacitive means, the measurement is affected by moisture, for example. This can act externally on all slivers together, or it can affect individual slivers only, for example because these were exposed to more moisture in their cans prior to drawing than the other slivers. The known processes and devices therefore operate with rather inaccurate measured values or with slivers which have already been exposed to inadequate pretreatment.

As characterised in the claims, the object of the invention is therefore to create a process and a device of the above-mentioned type, that delivers a more accurate measured value and in so doing affects the slivers to the smallest possible extent.

The object is achieved in that parameters are measured separately on each sliver and then converted into a common measured value for several slivers.

For this the feed measuring device has several measuring elements individually assigned to slivers, all of said measuring devices being connected to a computer. The latter can provide a single measuring signal for the control process in the drawing frame, which is composed of the individual measured values output by the measuring devices. The measuring elements are located near exits of cans and are preferably part of a device for withdrawing the sliver from a can. Therefore, the distances between the measuring elements and the draw frame are different for each sliver, when cans are aligned in one row.

The particular advantages achieved by the invention are that the individual slivers have no mutual effect on each other during measurement and thus more accurate values of parameters measured at the incoming slivers are available. In this case the individual measuring elements can be made lighter so that they can respond very rapidly to parameter changes and these changes can also be rapidly and accurately output as a measured value. Measuring elements designed for mechanically scanning the sliver can also be used, although the sliver needs to be driven in the proximity of the measuring element. But, a sliver drive element anyway present at the exit of each can may perform that driving function. These more accurate values can be used in the control device of the drawing frame to effect more accurate control, which has an improved response to parameter fluctuations and which ultimately leads to a more uniform sliver at the output of the drawing frame, which more accurately corresponds to the setpoint for the parameter. It is also possible for the measuring elements to fulfill further functions, for example, where these monitor each individual sliver and trigger an indication, an alarm or another function in the case of particularly bad slivers.

Figure 3:
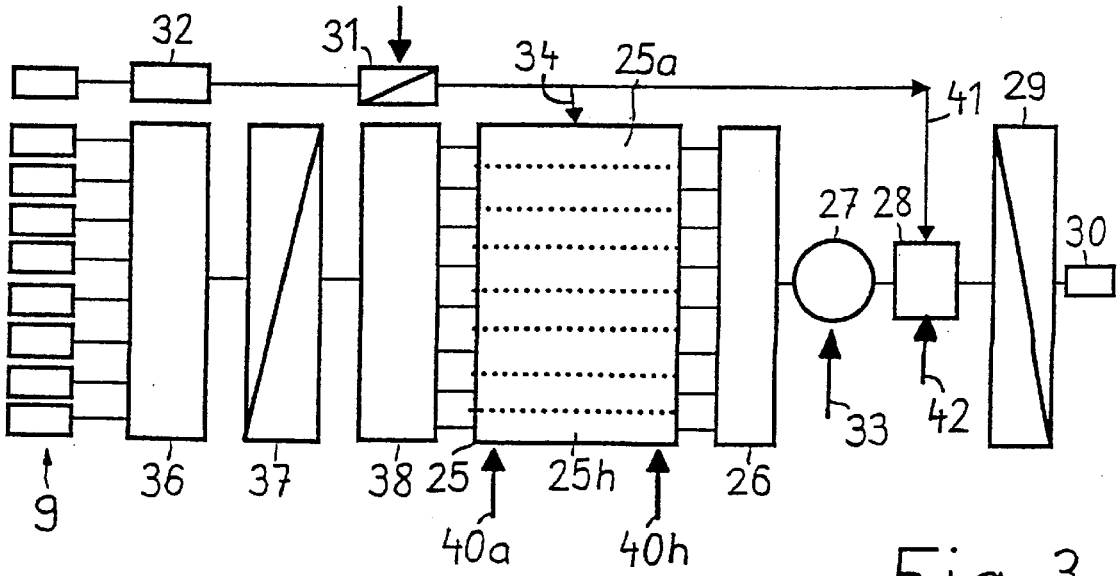
Figure 4:
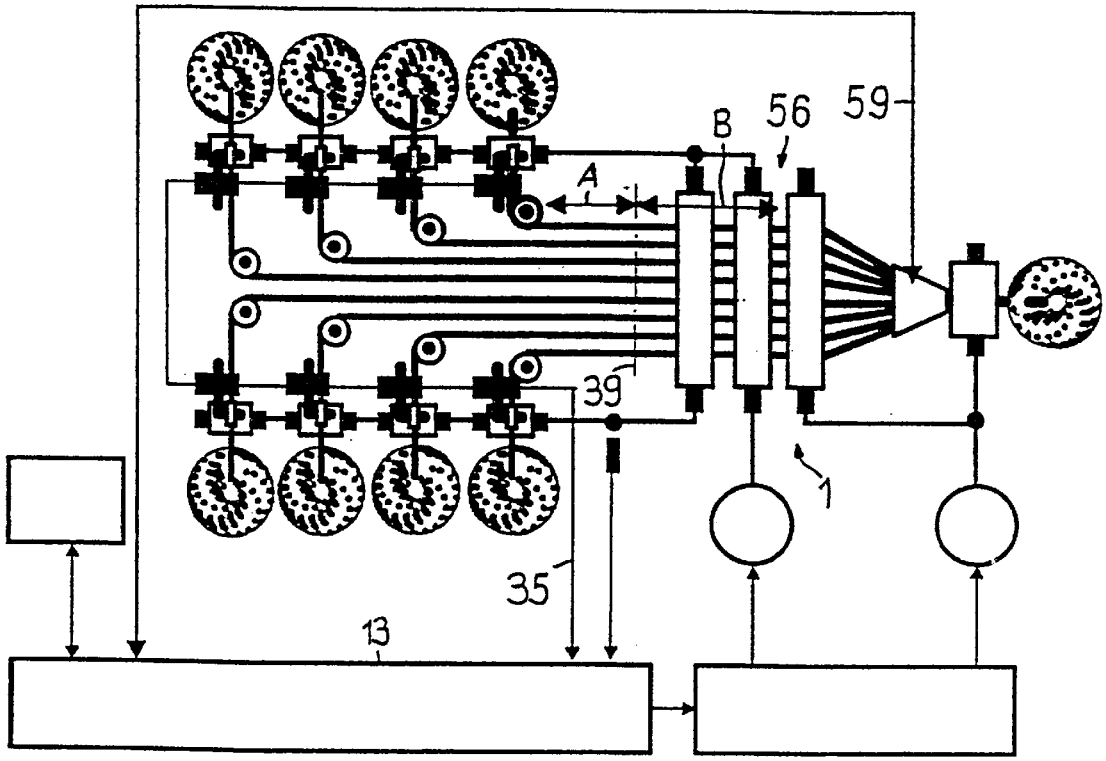
Figure 5:
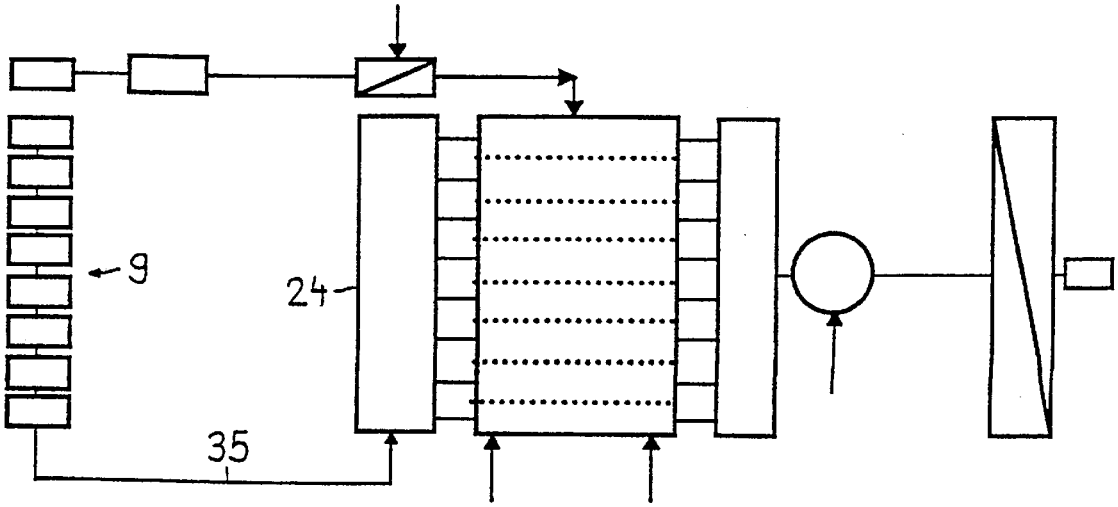
Figure 6:
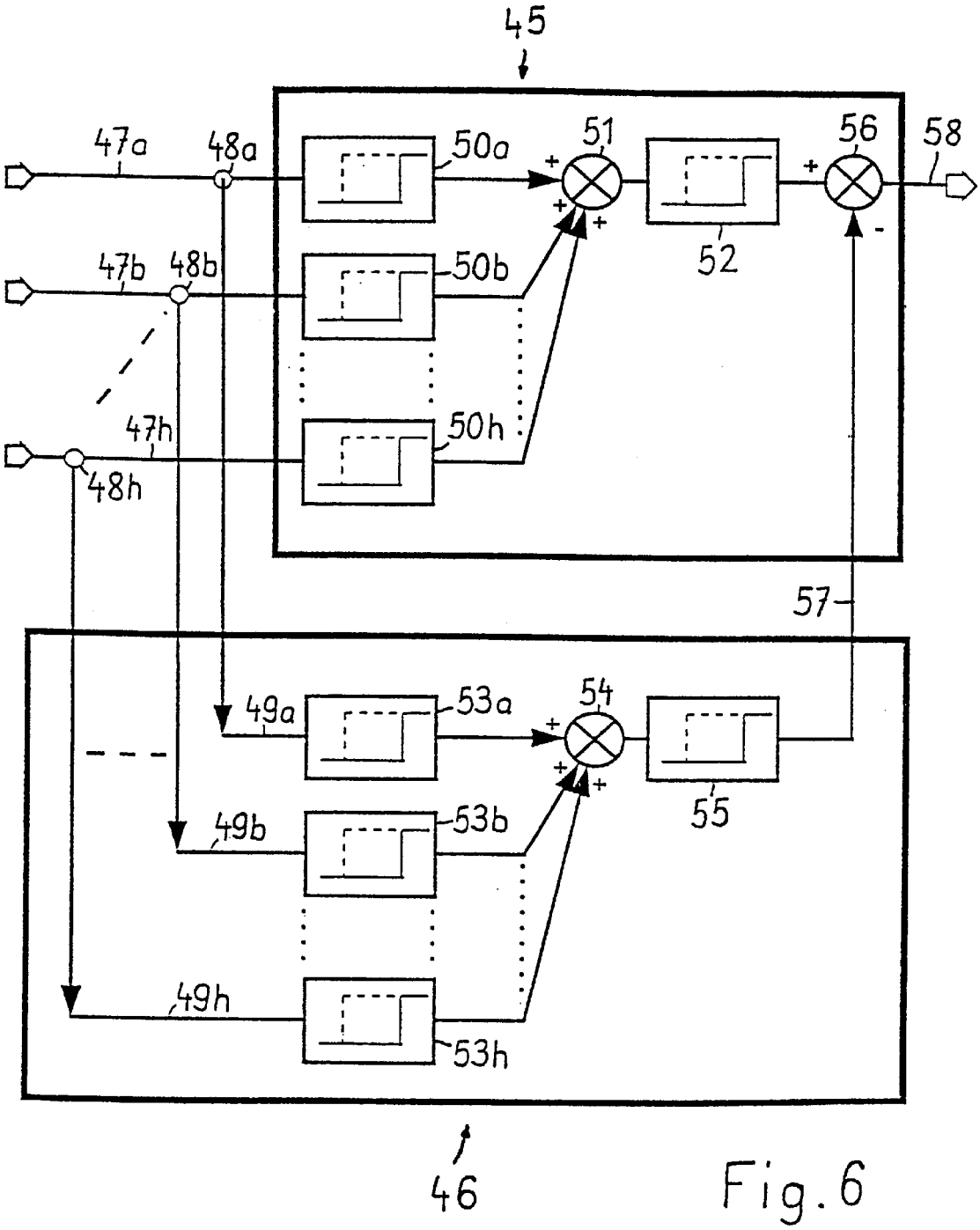

The invention is explained in more detail below with the aid of an example and with reference to the accompanying drawings, of which:

FIGS. 1 and 4 each show a schematic representation of the construction of a controlled drawing frame with a feed measuring device, FIG. 2 shows a measuring element for the feed measuring device, FIGS. 3 and 5 each show a schematic representation of the construction of a computer for processing the signals of the individual measuring elements, and FIG. 6 shows a schematic representation of the processing of the measured values for the control of the drawing frame.

FIG. 1 shows a drawing frame 1, that consists in the known manner of several pairs of rollers 2, 3, 4, only one roller of each pair being visible here. A coiler trumpet 5, a calender roll 6 and a can 7 to receive the controlled sliver are arranged on the downstream side of the drawing frame 1. These are also known elements. Guide rollers 8, as well as eight measuring elements 9*a*, 9*b*, 9*c*, 9*d*, 9*e*, 9*f*, 9*g*, 9*h* and eight cans 10*a*–10*h* for eight slivers are provided upstream of the drawing frame 1. In FIG. 1, reference characters 11*a*, 11*d*, 11*e*, and 11*h* have been applied respectively to the slivers drawn from cans 10*a*, 10*d*, 11*e*, and 10*h*. Also provided are lines (two of which are designated 12*a* and 12*d*, respectively in the drawings) which connect all measuring elements 9 in parallel with the computer 13. The latter is also linked to an operator control unit 14 and a tacho-generator 15 that is arranged on a drive train 16 for the measuring elements 9, for example. Here the measuring elements 9 can be part of a device for withdrawing the sliver 11 from a can 10. A variable-speed motor 17 and a main motor 18, which on the one hand are connected to a servo drive 19 and on the other hand are connected to the pairs of rollers 2, 3, 4 and the calender roll 6, are provided for the drawing frame 1.

FIG. 2 shows a measuring element 9 for a sliver 11. It consists, for example, of a driven roller 20 and an idler roller 21 that is supported on a lever 23 and rotates about a pivot axis 22. The roller 20 has a slot for the sliver 11, for example, into which the roller 21 can also penetrate to sense the sliver 11.

FIG. 3 shows schematically a possible construction for the computer 13. A delay element 25, with eight zones (two of which are designated 25*a* and 25*h* in FIG. 3) separate delays for each signal assigned to a measuring element 9*a*–9*h*, and a summer 26, are provided in this construction. A linearization stage 27, a delay stage 28, a digital/analogue converter 29 and a connection 30 to the servo drive 19 follow said summer. A multiplexer 36 with inputs for signals from the measuring elements 9, an analogue/digital converter 37 and a demultiplexer 38 are connected upstream of the delay element 25. The delay element 25 and the delay stage 28 are additionally linked via a speed computer 31 to a counter 32 that can also form part of the tacho-generator 15 and is provided for pulse counting. The linearization stage 27 has at least one input 33 for linearization parameters. The delay element 25 has an input 34 for speed and eight inputs (two of which are designated 40*a* and 40*h* in FIG. 3) for distances, via which the magnitude of the delay in the individual zones 25*a* to 25*h* can be determined. The delay stage 28 likewise has an input 41 for the sliver speed and an input 42 for entering a distance or displacement for the slivers 11.

FIG. 4 shows a drawing frame 1 with a feed measuring device as already illustrated in principle in FIG. 1. The same reference numbers are therefore used for identical elements. This also applies when they are not shown here. But the embodiment shown in FIG. 4 differs in that the measuring elements 9*a*–9*h* are connected in series with the computer 13 via a data bus 35.

FIG. 5 shows a construction for a computer 13 similar to that of FIG. 3. Here again identical elements are given the same reference numbers. A serial interface 24 to which the data bus 35 with the measuring elements 9 is linked, is connected upstream of the delay element 25.

FIG. 6 shows a partial and schematic representation of certain aspects of the mode of operation of the drawing frame 1 and the control system. In this case the drawing frame 45 and the controller 46 are therefore represented here with the important signal processing functions. Disturbance variables or sliver defects which can be registered at measuring points 48*a*, 48*b*, 48*h*, are denoted by 47*a* to 47*h*. For clarity, only disturbance variables 47*a*, 47*b* and 47*h* are shown. The number of corresponding disturbance variables and elements associated with them actually equals the number of slivers. The disturbance variables 47*a* to 47*h* produce measuring signals 49*a*, 49*b*, 49*h* for the controller 46 at the measuring points 48*a* to 48*h*. After the measuring points 48 the disturbance variables are displaced during different times which are peculiar to each sliver, until they reach the actual drawing frame or a reference point 39. This means that in so doing the disturbance variables undergo delays that occur in function blocks 50*a*, 50*b* and 50*h*. Calculated from the reference point 39 onwards, which can be positioned before or in the actual drawing frame and is represented here by a summer 51, all slivers and thus all disturbance variables 47 have the same delay which occurs in the function block 52. Corresponding function blocks 53*a*, 53*b*, 53*h*, as well as 54 and 55 for the individual delays of the measuring signals, the common delay of the measuring signals and for the summing of the measuring signals, are provided in the controller 46. 56 denotes a control point in the drawing frame which takes the delayed manipulated variables 57 from the controller 46 and thus varies the draft in the drawing frame. A controlled variable 58 or just a corrected, homogenous sliver is thus produced at the output of the drawing frame.

The mode of operation is as follows:

Each sliver 11 entering the drawing frame 1 is first scanned in a measuring element 9 to detect a parameter. The weight, thickness, mass, etc can preferably be considered as absolute values, or relative values such as changes in weight, thickness or mass. Such parameters are registered in a measuring element 9, as shown in FIG. 2. Here for example, the roller 21 is deflected by the volume applied by the sliver 11 to the roller 20, which is converted into an output signal that is proportional to this deflection. The output signals of all measuring elements 9 are fed in serial form via the data bus 35 or in parallel via the lines 12 to the computer 13 which calculates from all output signals a single output signal representing the absolute value of the relevant parameter, that is fed to the servo drive 19. The drawing frame 1 is thus controlled in the known per se manner, which is therefore not described in further detail here.

If the output signals arrive at the serial interface 24 in the computer 13 via the bus 35, then they are individually delayed in the delay element 25 so that the different distances A (FIG. 4) from the individual measuring elements 9 or the guide rollers 8 along the slivers 11 to the first pair of rollers 2 or another selectable reference point 39 in or prior to the drawing frame 1 are adjusted as if these measuring elements 9 had been located at the relevant selected reference point 39. The values delayed in this manner are then summed to a value in the summer 26 and this value is linearized in the linearization stage 27. If necessary, a delay common to all signals is applied in the delay stage 28, which is only necessary if said reference point 39 is provided and is located at a distance B before a control point 56 of the drawing frame 1. However, the distances A and B can also be compensated together in the delay element 25. The values now available for the parameters of all slivers 11 are computed and converted into an analogue signal in the digital/analogue converter 29 and supplied to the servo drive 19 via the output 30.

If the output signals arrive via the lines 12, the output signals are multiplexed in the multiplexer 36 and digitized in the converter 37 before they are again demultiplexed in the demultiplexer 38 and individually delayed in the delay element 25 in the known manner.

As can be seen from FIG. 6, the measuring signals undergo the same delays and logical combination as the individual slivers or the disturbance variables which affect the slivers. Parameters to achieve such delays can be entered into the controller 13 via the inputs 40 and 42.

Measuring elements other than those shown in FIG. 2 can of course also be used for a parameter. However, other measuring elements are also necessary when other parameters such as fibre count or colour are to be used for control of the drawing frame 1. Such additional measuring elements or measuring principles are illustrated in Swiss patent application No. CH 2128/95, for example.

The process and device according to the invention can also be used in combined open and closed control loops, or combined with monitoring of the emerging sliver. In this case, the computer 13 is connected via a line 59 to the coiler trumpet 5, as is shown in FIG. 4.

It is possible, moreover, to individually feed the signals coming from the individual measuring elements 9*a* to 9*h* to an evaluator which is not directly related to the control. For example, each sliver could be monitored with a view to certain conditions being met. Each measured value could thus be compared to a threshold value to ensure that a sliver is present anyway, or that the sliver attains a minimum volume. If such conditions are not met, then the drawing frame could be stopped. Such additional functions could also be carried out by the controller 13. The invention can be employed on drawing frames, particularly those provided in drafting machines and combing machines.

I claim:

1. Process for recording a parameter on several slivers (11) fed to a drawing frame (1), characterized in that the parameter is measured separately at each sliver and at different distances from the drawing frame and is then converted to a common measured value (58) for several slivers; in that the parameter is measured at a measuring point (48) at a distance (A) from a selectable reference point (39) in or prior to the drawing frame; and in that the measured value is used for the control of the drawing frame and that after the sliver(s) have been measured the parameter is delayed in proportion to the distance (A) and to the speed of the sliver.

2. Process according to claim 1, characterized in that the distance to a predetermined reference point (39) prior to the drawing frame is measured and that the parameter for each sliver is individually delayed in accordance with the distance from the predetermined reference point and in accordance with the speed of the sliver.

3. Process according to claim 2, characterized in that a further distance (B) from the reference point (39) to the drawing frame (1) is identical for all slivers (11) and is allowed for by a common delay for all parameters.

* * * * *